US007662004B1

(12) United States Patent
March et al.

(10) Patent No.: US 7,662,004 B1
(45) Date of Patent: Feb. 16, 2010

(54) HUMAN-POWERED FLAPPING HYDROFOIL CRAFT

(76) Inventors: Philip A. March, 2710 King Richard Dr., El Dorado Hills, CA (US) 95762; John R. Ridgely, 355 Highland Dr., Los Osos, CA (US) 93402; Sherwood P. Gibson, 6724 Hickory Ave., Orangevale, CA (US) 95662; Peter R. March, 2919 Old Oak Tree Way, Rocklin, CA (US) 95765

( * ) Notice: Subject to any disclaimer, the term of this patent is extended or adjusted under 35 U.S.C. 154(b) by 112 days.

(21) Appl. No.: 11/985,404

(22) Filed: Nov. 14, 2007

Related U.S. Application Data

(60) Provisional application No. 60/858,766, filed on Nov. 14, 2006, provisional application No. 60/860,025, filed on Nov. 20, 2006.

(51) Int. Cl.
*B63H 1/36* (2006.01)

(52) U.S. Cl. ..... 440/14; 440/26; 440/32

(58) Field of Classification Search ..... 440/14, 440/21, 22, 26, 32
See application file for complete search history.

(56) References Cited

U.S. PATENT DOCUMENTS

| | | | | |
|---|---|---|---|---|
| 5,127,855 | A * | 7/1992 | Heywood | 440/14 |
| 5,718,611 | A * | 2/1998 | Schlangen et al. | 440/27 |
| 6,099,369 | A | 8/2000 | Puzey | |
| 7,021,232 | B2 | 4/2006 | Chen | |

* cited by examiner

*Primary Examiner*—Stephen Avila
(74) *Attorney, Agent, or Firm*—Heisler & Associates

(57) ABSTRACT

A pair of foils are pivotably coupled to a nacelle. The nacelle is pivotably coupled to a mast extending down from to a frame and below a water surface. A push rod oscillates, causing the nacelle to experience a heaving motion, in turn causing the foils to flap up and down. The push rod is driven by a power plant such as a human rider. Angles of attack for the foils are actively controlled to optimize lift and propulsion forces provided by the foils to cause the water craft to move over the water. A steering fin is also provided for heading control of the water craft. A control system for separate angles of attack for the foil sends appropriate information to servo motors which cause the foils to rotate relative to the nacelle to achieve optimal angles of attack relative to the particular position of the nacelle at any given moment.

19 Claims, 5 Drawing Sheets

HUMAN-POWERED FLAPPING HYDROFOIL CRAFT

CROSS-REFERENCE TO RELATED APPLICATIONS

This application claims benefit under Title 35, United States Code § 119(e) of U.S. Provisional Application No. 60/858,766 filed on Nov. 14, 2006 and U.S. Provisional Application No. 60/860,025 filed on Nov. 20, 2006.

FIELD OF THE INVENTION

The following invention relates to hydrofoil water craft which utilize submerged foils to carry a weight of the vehicle over a surface of the water without substantial contact with the surface. More particularly, this invention relates to hydrofoil water craft which include foils which flap up and down to both provide lift and propulsion for the vehicle.

BACKGROUND OF THE INVENTION

Flapping foil hydrofoil water craft are known in the prior art. Exemplary of such flapping foil hydrofoil water craft are the devices disclosed in U.S. Pat. No. 7,021,232 and U.S. Pat. No. 6,099,369. These prior art devices are generally characterized by including a foil which moves up and down with an angle of attack of the foil adjusting to maintain propulsion in a forward direction, such that vehicle motion somewhat akin to that of the flukes of a whale tale can be provided. Such flapping foil hydrofoil devices in the prior art also are characterized by including a front foil structure for maintaining balance for the water craft.

These prior art water craft are particularly characterized in a high degree of bobbing up and down as they move over the water. This invention solves such a bobbing problem by utilizing two flapping foils which undergo a heaving (flapping up and down) motion following a sinusoidal pattern, typically 180° out of phase from each other. With this invention, the non trivial problem of optimizing angle of attack for each of the foils throughout their oscillation cycle has also been solved.

SUMMARY OF THE INVENTION

With this invention a frame is provided generally above the water and which carries a rider thereon as well as a power plant, either in the form of the rider's own physical power or a separate power supply. A mast of the frame extends down through the water to a nacelle. This nacelle acts as a submerged structure which is elongate in form and extends in a forward and rearward direction from the mast. The nacelle can pivot up and down relative to the mast. A front foil is pivotably attached to the nacelle forward of the mast. A rear foil is pivotably attached to the nacelle rearward of the mast.

The nacelle is caused to oscillate in a heaving manner through action of a push rod coupled to the nacelle behind the mast and moving up and down. The push rod is driven by the power plant on the frame. In a preferred embodiment, the push rod is coupled eccentrically to a sprocket driven by a chain coupled to pedals on a crank shaft, so that the rider can also supply the power required to drive the water craft.

An angle of attack control system is coupled to the front foil and the rear foil to control angle of attack of the foils on a continuous basis to optimize angle of attack for the foils as the nacelle oscillates. Generally, the angles of attack for each foil are continuously changing to minimize forces detrimental to production of lift and propulsion when the foils are moving upward and maximizing propulsion, and maximizing lift and propulsion characteristics when the foils are moving in a downward direction. In one form of the invention this control is in the form of a pair of servo motors located within the nacelle, with each of the servo motors coupled to one of the foils. A controller receives as input a crank angle for some portion of the power plant which directly correlates with an angular position of the nacelle. This nacelle position could also be directly monitored if desired and inputted into the controller.

Through careful analysis, the inventors have determined the most preferable angles of attack for the front foil and the rear foil for each position of the nacelle. Thus, when the position of the nacelle is inputted into the controller, the controller outputs desired positions for the front foil and the rear foil. This information is translated into electric signals sent to the servo motors to cause the servo motors to act upon the foils to position them where desired for optimal performance. Alternatives to such a computer/electronic control system include fully mechanical systems where the foils have their angles of attack modified by control forces applied by rods, cams, cables, gears or other elements that are driven by the motion and position of the nacelle to properly set the foil angles of attack.

Most preferably, a steering fin is also provided extending from the frame into the water which can be pivoted, such as by pivoting of a handlebar mounted to the frame, to cause the steering fin to rotate generally about a vertical axis and allow the water craft to be steered. This fin can also include a foil thereon and a float so that an automatic control system is provided for balancing of the water craft. Alternatively, such water craft balance can be provided in a more active fashion by measuring depth of the vehicle or tilt angle of the vehicle overall and inputting this information into the control system to make minor adjustments to angle of attack information for the front foil or the rear foil so that the front foil and rear foil provide appropriate forces for maintaining balance of the water craft.

OBJECTS OF THE INVENTION

Accordingly, a primary object of the present invention is to provide a water craft which can successfully carry a rider over a water surface between an origin and a destination in a controlled fashion.

Another object of the present invention is to provide a water craft which can be powered by human power alone.

Another object of the present invention is to provide a water craft which can travel at relatively high speeds for a human powered water craft.

Another object of the present invention is to provide a water craft which can be powered either by human power or by a motor or other power supply.

Another object of the present invention is to provide a water craft which can maintain balance and avoid excessive bobbing while still utilizing flapping foils for propulsion and lift.

Another object of the present invention is to provide a control system for continuously controlling angles of attack of front and rear foils of a dual flapping foil hydrofoil water craft.

Another object of the present invention is to provide a personal water craft which is easy to use with easy to operate controls and a high degree of power transfer from the user into propulsion of the craft.

Other further objects of the present invention will become apparent from a careful reading of the included drawing figures, the claims and detailed description of the invention.

DESCRIPTION OF THE PREFERRED EMBODIMENT

Figure 1:
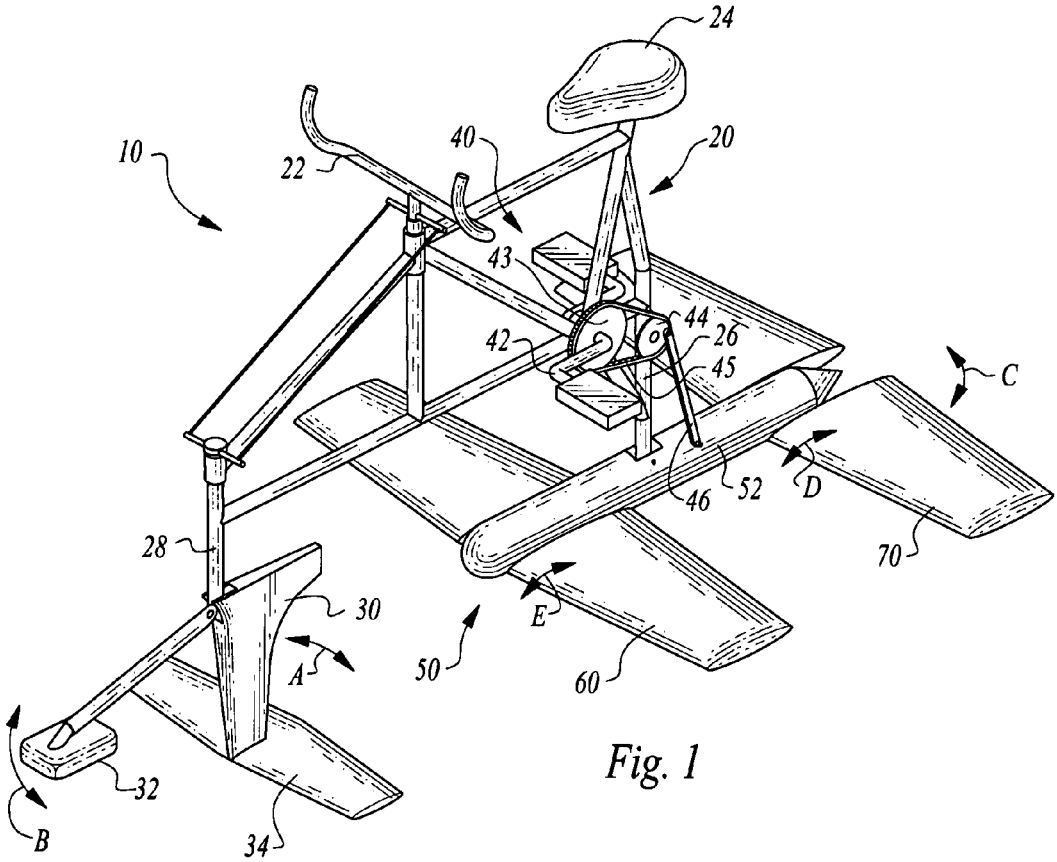
FIG. 1 is a perspective view of the human-powered flapping hydrofoil craft of this invention according to a preferred embodiment.

Referring to the drawings, wherein like reference numerals represent like parts throughout the various drawing figures, reference numeral 10 (FIG. 1) is directed to a water craft for conveying a human rider and potentially cargo over water. The water craft 10 utilizes a front foil 60 and rear foil 70 oscillating in a flapping motion to provide both propulsion and lift. Angles of attack for the foils 60, 70 are carefully controlled to optimize lift and propulsion to provide a smooth and efficient ride.

In essence, and with particular reference to FIG. 1, basic details of this invention are described, according to a preferred embodiment. The water craft 10 includes a frame 20 which is mostly oriented above a surface of the water. A steering fin 30 extends down from a forward portion of the frame 20 into the water for control of steering for the water craft 10. A power plant 40 is coupled to the frame 20 and outputs power for generation of propulsion and lift to carry the water craft 10 over the water. A nacelle 50 is pivotally attached to a mast of the frame in a submerged position. The nacelle 50 is caused to pivot by the power plant 40.

In this preferred embodiment, the power plant 40 is in the form of a human rider pushing on pedals to in turn cause the nacelle 50 to pivot in an oscillating and repeating up and down typical fashion. The front foil 60 extends laterally from a portion of the nacelle 50 forward of the mast 26 of the frame 20. A rear foil 70 extends laterally from the nacelle 50 rearward of the mast 26. A control system 80 (FIG. 7) controls angles of attack of the front foil 60 and rear foil 70 so that net lift and propulsion forces maintain the craft 10 moving steadily forward and at a substantially constant depth over the water.

More specifically, and with particular reference to FIG. 1, particular details of the frame 20 are described. The frame 20 is preferably generally similar in form to that of a standard bicycle. Various tubular members are rigidly coupled together to form a somewhat truss-like structure with a portion of this structure supporting a seat 24 and a portion of this structure supporting handlebars 22. Importantly, a mast 26 extends down from the frame 20 through a surface of the water to pivotably support the nacelle 50 in a submerged position.

A steering column 28 is provided on a forward portion of the frame 20. Preferably, this steering column 28 is in the form of a sleeve with a shaft passing therethrough that can rotate. Upper portions of a rotating inner shaft of this steering column 28 are coupled to the handlebars 22 in such a way that when the handlebars 22 are rotated, the inner shaft within the steering column 28 is also caused to rotate.

With continuing reference to FIG. 1, details of the steering fin 30 are described. The steering fin 30 preferably extends down from the inner shaft within the steering column 28, such that the steering fin 30 is caused to rotate about a substantially vertical axis (along arrow A of FIG. 1) when the handlebars 22 rotate. Interconnection of the handlebars 22 with the steering fin 30 can occur by guide cables or by other mechanical linkages.

The steering fin 30 is preferably in the form of a somewhat planar rigid structure oriented within a substantially vertical plane and adapted to pivot about a substantially vertical axis. The steering fin 30 is preferably bilaterally symmetrical with a rounded leading edge and a pointed trailing edge so that a generally teardrop horizontal cross-sectional form is provided that is streamlined to minimize resistance.

The steering fin 30 is also preferably longer on an upper portion thereof and shorter at a lower portion thereof. In this way, the steering fin 30 provides a greater steering force at low speeds before the steering fin 30 is "flying" due to action of a fore foil 34 coupled to a lower end of the steering fin 30.

This fore foil 34 is preferably constructed with an air foil contour and extends laterally substantially horizontally in both directions away from a lower end of the steering fin 30. The fore foil 34 thus provides a slight amount of lift for a forward portion of the water craft 10. Most preferably, the steering fin 30 and fore foil 34 are rigidly coupled together.

The steering fin 30 can preferably pivot about a horizontal axis transverse to a direction of water craft 10 motion. A lead float 32 is preferably also coupled rigidly to the steering fin 30 and fore foil 34. When the lead float 32 is driven below a surface of the water, it will tend to rotate upward (along arrow B of FIG. 1). This in turn will cause the fore foil 34 to have its angle of attack increase and cause the fore foil 34 to fly upward, increasing a height of a forward portion of the frame 20. This in turn will lift the lead float 32 out of the water, causing rotation of the steering fin 30 and fore foil 34 in a downward direction, thus decreasing upward forces on a forward portion of the frame 20. In this way, a form of automatic leveling control can be provided. When the steering fin 30 is rotated about a vertical axis (about arrow A of FIG. 1) the steering fin 30 causes a forward portion of the frame 20 to rotate in a corresponding direction, so that a heading of the water craft 10 can be adjusted.

Figure 2:
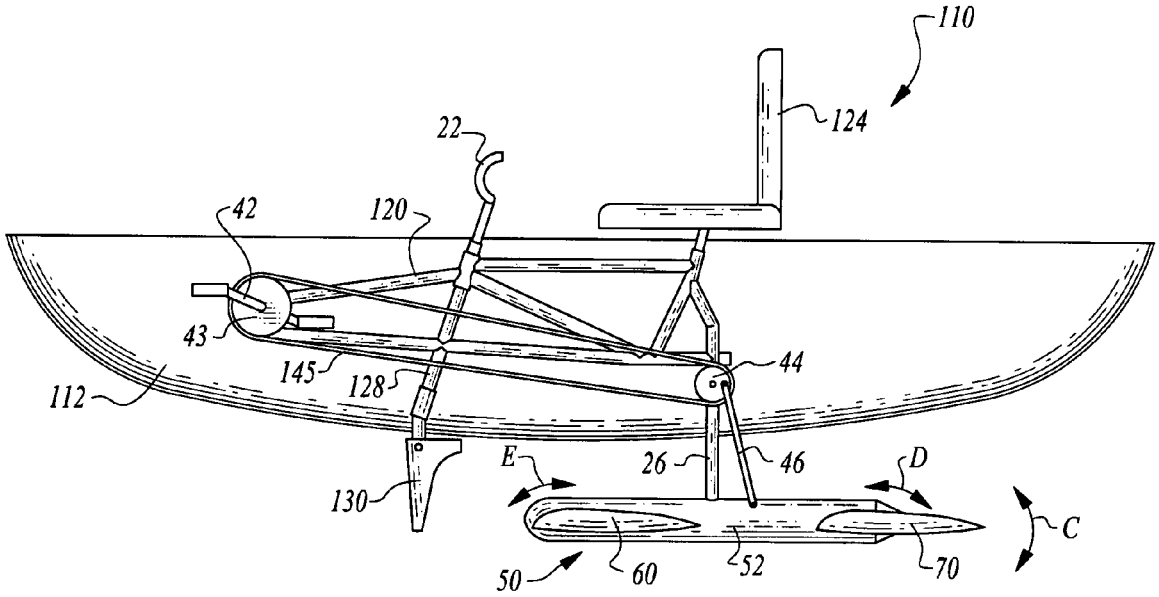
FIG. 2 is a side elevation view of a first alternative embodiment of that which is shown in FIG. 1.
Figure 3:
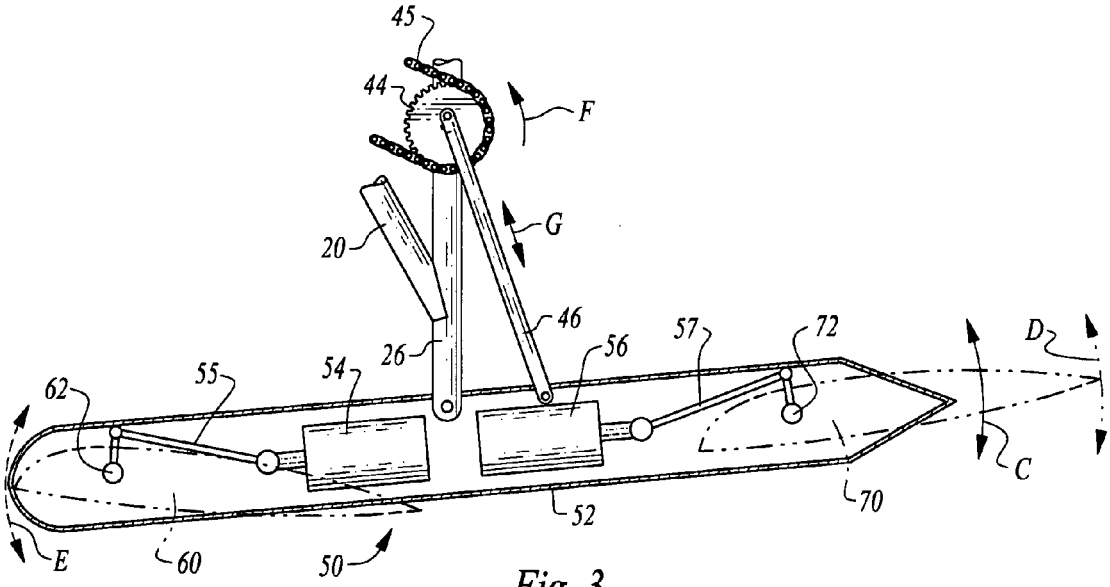
FIG. 3 is a side elevation view of a nacelle portion of the craft of this invention with portions of a shell of the nacelle cut away to reveal interior details, and with the foils shown in phantom.
Figure 4:
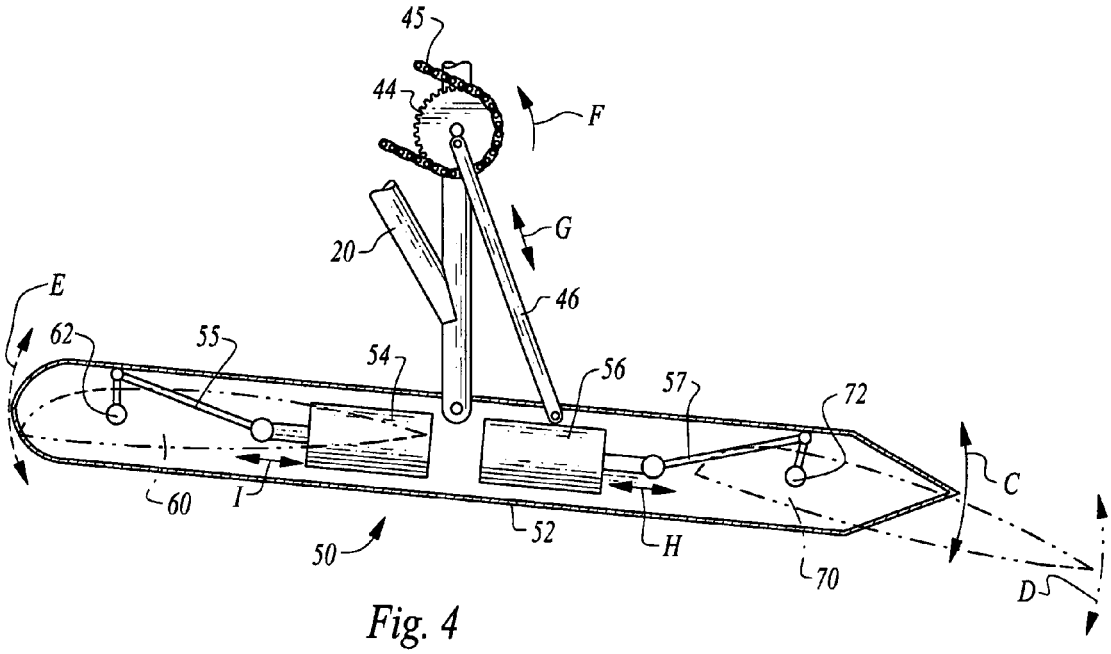
FIG. 4 is a side elevation view similar to that which is shown in FIG. 3 but with the nacelle having pivoted to a new position.

With reference to FIGS. 1, 3 and 4, particular details of the power plant 40 of the water craft 10 are described, according to the preferred embodiment. The power plant 40 in the preferred embodiment is in the form of human power delivered to the water craft 10 through pedals. Such power input is akin to that provided by a standard bicycle. As an alternative, an electric motor, internal combustion engine or some other form of power plant could be utilized. Such motors typically have a rotating output and such rotating output could be directly coupled to a sprocket 44 for driving of a push rod 46 to cause desired motion of the water craft 10. Such motors could be mounted to the frame or carried on a hull, such as the hull 112 (FIG. 2).

The preferred power plant 40 includes the pedals coupled to a crank shaft 42 rotatably mounted to the frame 20. This crank shaft 42 is also coupled to a drive sprocket 43 which carries a chain 45 thereon. The chain 45 interfaces with a following sprocket 44 that is also rotatably mounted to the frame 20. A push rod 46 is coupled eccentrically to the following sprocket 44. Thus, when a user rotates the pedals coupled to the crank shaft 42, the push rod 46 is caused to move up and down.

If desired, both a non-human power plant and human power can be utilized together, either in an alternating fashion or simultaneously, such as by adding further sprockets and chains to add power to the following sprocket 44. The following sprocket 44 acts as a rotating driver in this embodiment to cause the push rod 46 to oscillate. Gears or other linkages could alternatively be used for human powered or non-human powered versions of this invention.

With particular reference to FIGS. 3 and 4, particular details of the nacelle 50 of this invention are described according to a preferred embodiment. The nacelle 50 provides a preferred form of submerged structure for pivotably carrying the front foil 60 and rear foil 70. This pivoting of the nacelle 50 can also be referred to as "flapping" or "heaving." The nacelle 50 in its preferred form is a hollow elongate rigid shell 52 having a generally streamlined shape, in at least one form somewhat shaped like a torpedo. The nacelle 50 thus includes the shell 52 that provides this streamlined contour and with a hollow interior. The push rod 46 is coupled to the nacelle 50 at a location spaced from where the shell 52 of the nacelle 50 is pivotably attached to the lower end of the mast 26 of the frame 20. Thus, when the push rod 46 moves up and down (along arrow G), the nacelle 50 is caused to oscillate (about arrow C of FIGS. 3 and 4). Push rod 46 movement is in turn caused by rotation of the following sprocket 44 along arrow F (FIGS. 3 and 4).

A careful study of the oscillation of the nacelle 50 as well as the orientation of the front foil 60 and rear foil 70 illustrates that if an angle of attack of the foils 60, 70 remains constant, some of the time the foils will be providing a desired amount of propulsion forces in a forward direction and some of the time they will be producing negative forces counteracting propulsion in a forward direction. Furthermore, lift forces for the foils are not optimized throughout the oscillation cycle of the nacelle 50 if the foils 60, 70 remain fixed relative to the nacelle 50. Thus, with this invention angles of attack of the foils 60, 70 are continually adjusted to optimize propulsion and lift forces provided by the foils 60, 70. In particular, servo motors 54, 56 are located within the shell 52 of the nacelle 50. The front servo motor 54 is coupled to the front foil 60 through a drive pin 55. A rear servo motor 56 is coupled to the rear foil 70 through a drive pin 57. Each foil 60, 70 is pivotally attached to the nacelle 50 by an axle 62, 72, such that the foils 60, 70 can be relatively easily pivoted (about arrows D and E of FIGS. 1-4 and 7).

While the drive pins 55, 57 could be actuated by the servo motors 54, 56 in a variety of different ways, most preferably the servo motors 54, 56 have a rotating output which passes into a threaded nut. The drive pins 55, 57 preferably have an end closest to the servo motors 54, 56 which is threaded and rides within the threaded nut. Thus, when the servo motors 54, 56 provide a rotating output, they cause the threaded drive pins 55, 57 to be drawn toward or away from the servo motor 54, 56 (along arrows H and I of FIGS. 4 and 7) so in turn the drive pins 55, 57 can cause pivoting of the front foils 60 and rear foils 70.

Figure 5:
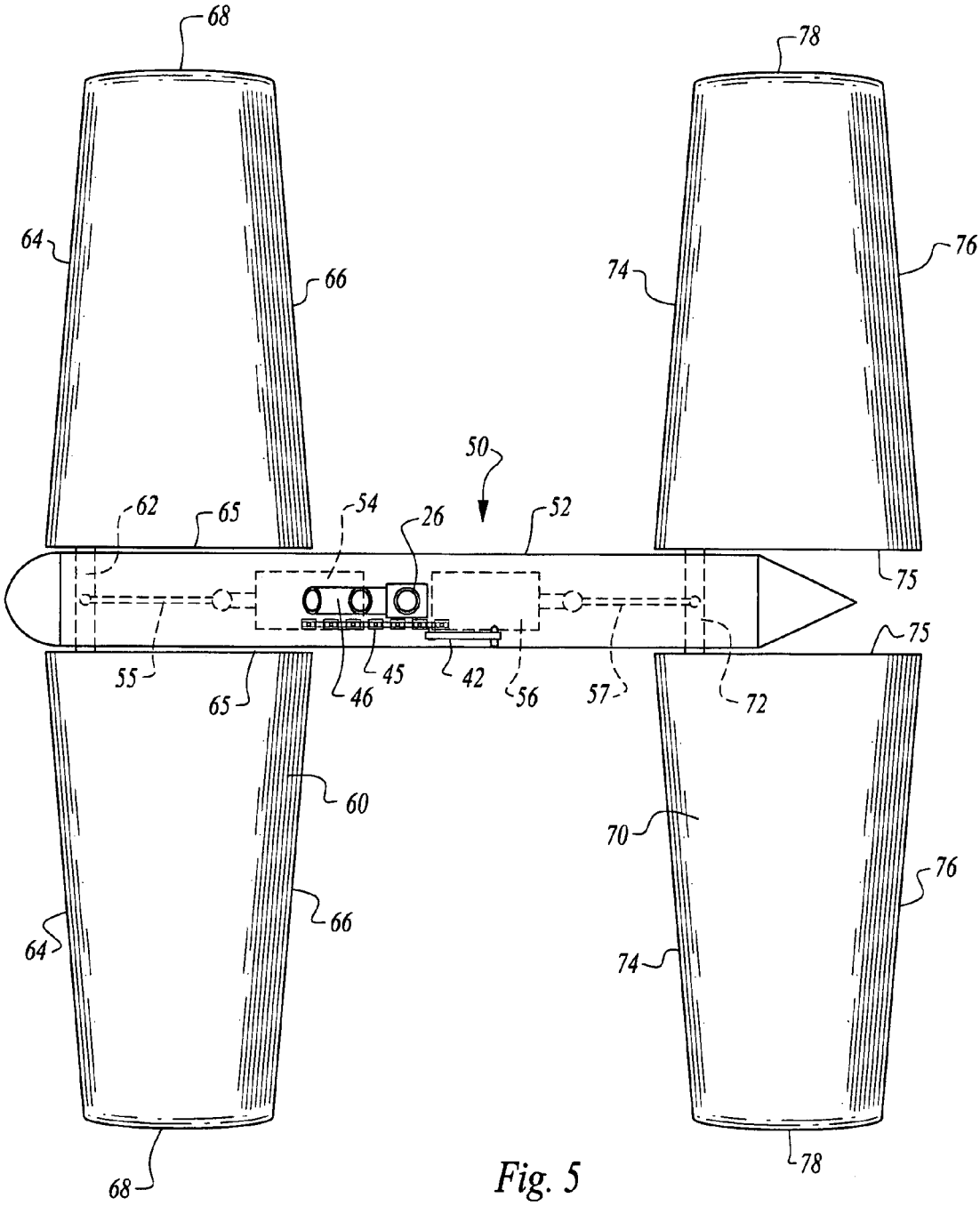
FIG. 5 is a top plan view of that which is shown in FIG. 1 and with portions of the craft above the power plant removed.

With particular reference to FIG. 5, details of the front foils 60 and rear foils 70 are described. These foils 60, 70 are each rotatably mounted to the nacelle 50 through axles 62, 72. Each foil 60, 70 preferably has a similar contour and is mounted in a similar fashion to the associated axle 62, 72. In particular, the axles 62, 72 preferably are coupled to roots 65, 75 of the foils 60, 70 at a location just ahead of the quarter cord point in the cross-section of the foils. Such axle 62, 72 position helps to stabilize the foils 60, 70 in a manner akin to that of a weather vane.

The foils 60, 70 each include leading edges 64, 74 and trailing edges 66, 76 which taper slightly towards each other as they extend from the roots 65, 75 to the tips 68, 78. In particular, the tips 68, 78 are preferably slightly shorter in forward length (about twenty percent) than at the root 65, 75. By tapering the leading edges 64, 74, any debris caught on the front foil 60 or rear foil 70 is more likely to be naturally shed over time. Preferably, the fore foil 34 of the steering fin 30 has a similar general contour as that of the front foil 60 and rear foil 70, except perhaps only half the size. Foils 60, 70 having a variety of different configurations could be provided to optimize performance of the water craft 10 or to provide other beneficial characteristics.

Figure 7:
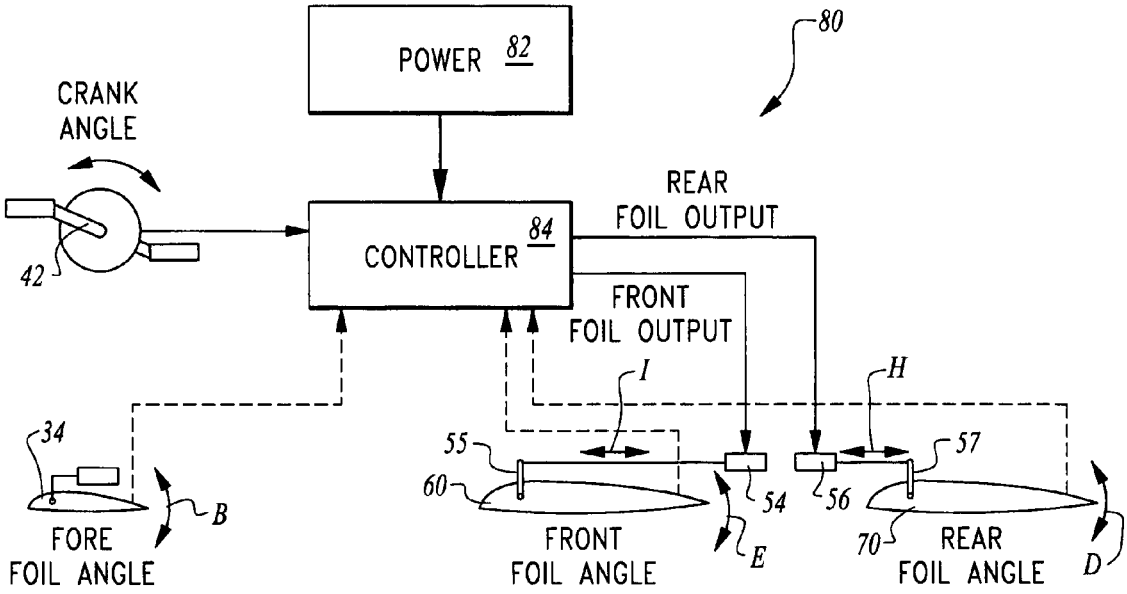
FIG. 7 is a schematic illustrating a control system for controlling angle of attack for the foils according to this invention.

With particular reference to FIG. 7, details of a control system 80 of this invention are described, according to a preferred embodiment. This control system provides a preferred form of control for angles of attack of the front foils 60 and rear foils 70. Such angles of attack are illustrated by arrows D and E of FIGS. 1-4 and 7 for the foils 60, 70. The control system 80 includes a power supply 82 that supplies power to a controller 84. In this preferred embodiment, the controller is a form of logic circuit, such as a central processing unit that has been programmed to respond as required for control of the angles of attack for the front foil 60 and rear foil 70. The controller could be programmed with a formula for a curve and perform repeated calculations to continuously calculate appropriate angles of attack based on the position/orientation of the nacelle 50, such as correlated with a crank angle of the crank shaft 42, or some other input correlating with a position of the nacelle 50. As an alternative to such an equation, the controller could include a database of appropriate angle of attack numbers for different nacelle 50 position. The controller could look up appropriate numbers from a table based on a crank angle input or other input correlating with a position of the nacelle to output appropriate angles of attack for the front foil 60 and rear foil 70.

Once the controller 84 has identified the appropriate positions for the front foil 60 and rear foil 70, correlating signals are sent to the servo motors 54, 56 to cause adjustment of the drive pins 55, 57 and in turn cause pivoting of the front foil 60 and rear foil 70 to have the proper angles of attack for the particular position that the nacelle 50 is currently at. The controller 84 and associated control system 80 would repeat these measurements on a sufficiently fast repeated basis to keep the control system 80 working properly. It is expected that proper control of this system will require repeated inputs into the controller and outputs to the front foil 60 and rear foil 70 on the order of milliseconds.

The power supply 82 and controller 84 could all be housed within the shell 52 of the nacelle 50, such as within a water tight compartment therein including batteries for the power supply 82 and a water tight enclosure for the controller 84. A sensor coupled to the crank shaft 42 or otherwise coupled to the nacelle 50 can act as the input for the control system 80. Outputs would be sent in the form of electric signals along wiring to the servo motors 54, 56. Servo motor 54, 56 output would be in the form of movement of the drive pins 55, 57 along arrows H and I of FIGS. 4 and 7.

While the basic control system 80 has been described, enhancements to the control system 80 could also be provided. For instance, if the fore foil 34 has a sensor thereon, the fore foil could provide depth information or information relating to the levelness of the overall water craft 10. The controller 84 could then make appropriate very small adjustments to angles of attack of the foils 60, 70 to provide any correction required to bring the water craft 10 back to a most preferred attitude. The actual positions of the front foil 60 and rear foil 70 could also be fed back to the controller 84 both to verify that the foils 60, 70 angles of attack are proper, and to otherwise fine tune the control system 80 for optimal performance. The controller 84 could also take into account other parameters such as weight of the rider and speed of the water craft to further optimize angle of attack output information to the servo motors 54, 56 for adjustment of angles of attack for the front foil 60 and rear foil 70.

An alternative control for the angles of attack of the foils 60, 70 would be to provide a mechanical control system that is driven by the angle of the nacelle (such as represented by the crank angle of the crank shaft) and which directly controls the foils. In particular, some form of mechanical element could be coupled to the foils on a portion of the foils spaced from the axles 62, 72. These elements could be in the form of rods, cables, cams, springs or other mechanical elements. These mechanical elements would push on the foils 60, 70 to cause rotation of the foils 60, 70. An amount of such rotation would be controlled by the position of the nacelle 50. As the nacelle 50 moves, the power used to cause the nacelle 50 to pivot would also cause forces to be applied into this control system. Appropriate linkages, gears, pulleys or other mechanical structures would be properly configured to extend from the nacelle 50 to the element providing input directly to the foils 60, 70 so that as the nacelle 50 oscillates, this mechanical control system applies forces to the foils 60, 70 causing angles of attack of the foils 60, 70 to be adjusted.

Such a mechanical control system could maintain similar performance at all speeds or the user could have some form of trim adjustment to tune the control system for different speeds or some form of mechanical speed sensor such as a spring and damper arrangement could adjust forces or travel distances of various linkages based on the speed at which the nacelle is oscillating, such that the control system can be optimized for speed.

With particular reference to FIG. 2, details of a first alternative embodiment water craft 110 are described. This alternative embodiment water craft 110 is particularly distinguished from the water craft 10 of the preferred embodiment (FIG. 1) in that it includes a hull 112 for flotation of the water craft 110 when not in use or when traveling at very low speeds. Furthermore, the frame 20 has been modified into a form generally similar to that of a recumbent bicycle rather than an upright bicycle.

In particular, details of the first alternative embodiment water craft 110 that are distinct from the water craft 10 of the preferred embodiment include a unique frame 120 generally similar to that of a recumbent bicycle and a steering fin 130 that in this embodiment does not include the fore foil 34. This water craft 110 relies on active balance and attitude control either merely by the hull 112 or by minor adjustments to angles of attack for the front foils 60 and rear foils 70. A steering column 128 is provided that is slightly modified and operates in a direct shaft arrangement between the handlebars 22 and the steering fin 130.

In this embodiment, a longer chain 145 is utilized to couple the crank shaft 42 to the following sprocket 44 and push rod 46. Finally, a unique seat 124 is provided best for accommodating a sitting down position and reclined position for the associated frame 120 configuration of this embodiment. Other details of the water craft 110 are similar to that described above in a preferred embodiment with reference to the water craft 10.

Figure 6:
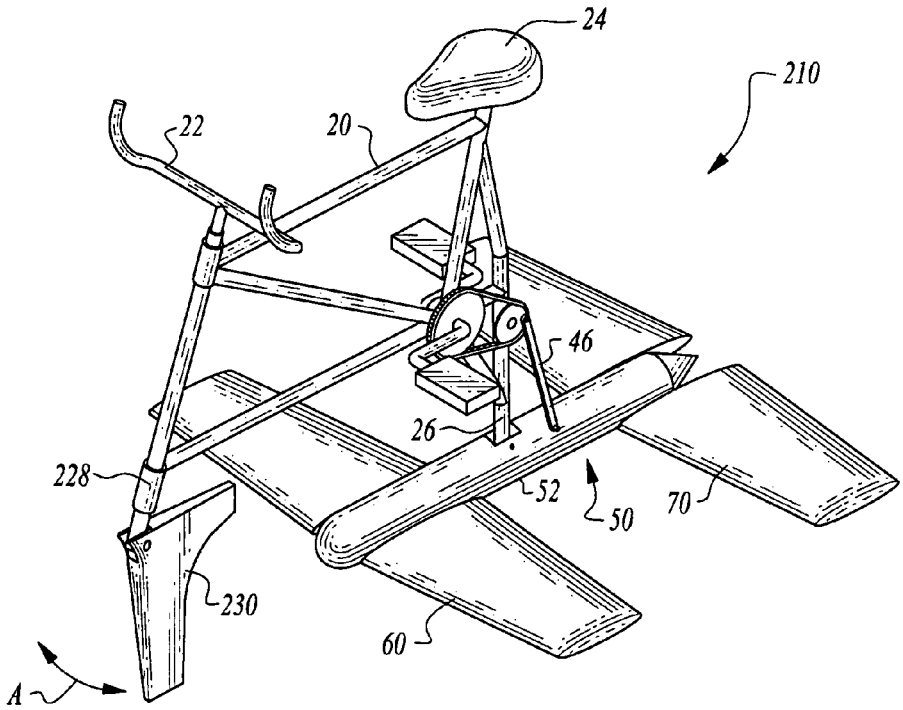
FIG. 6 is a perspective view of a second alternative embodiment of that which is shown in FIG. 1 where the steering fin only provides steering, but no balance for the craft.

With particular reference to FIG. 6, details of a further alternative embodiment are described. In this second alternative embodiment water craft 210, the steering column 228 has been modified to provide a direct drive arrangement for the steering fin 230. In this embodiment the control system 80 is fully relied upon for balancing of the water craft 210, such as by sensing an attitude of the frame 20 and sending a signal for angle of attack control of the front foil 60 and rear foil 70 appropriate to keep the water craft 210 appropriately balanced.

Figure 8:
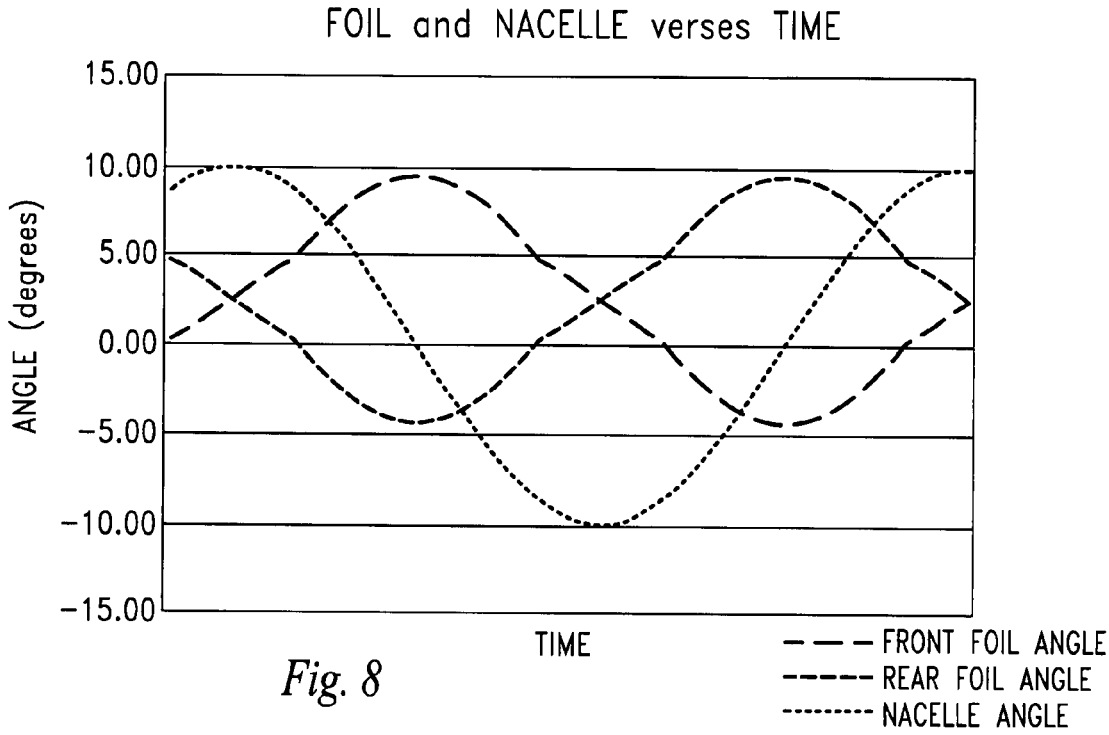
FIG. 8 is a graph of angles of attack of the front foil and rear foil and nacelle over time, indicating the correlation between front and rear foil angle of attack and nacelle angle.
Figure 9:
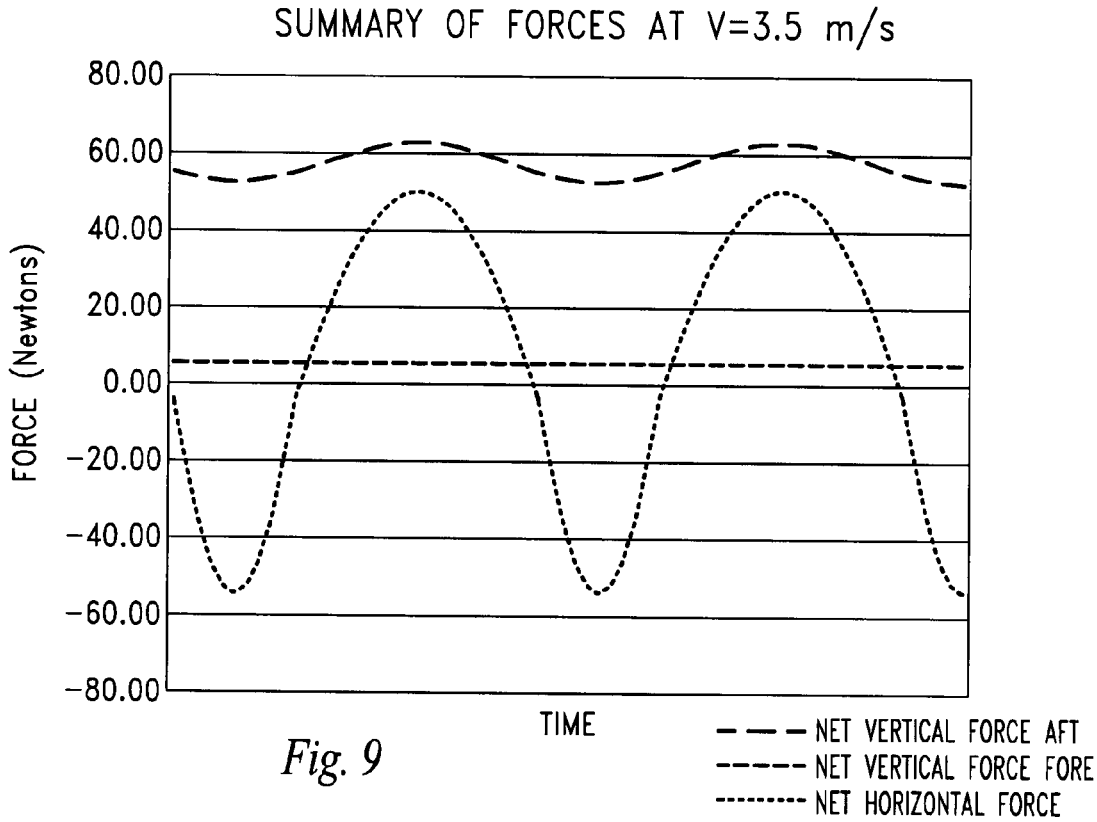
FIG. 9 is a graph of net vertical force for a fore foil and for an aft nacelle assembly including the front and rear foils, and with a net horizontal force also displayed relative to the passage of time.

With particular reference to FIGS. 8 and 9, details of the preferred position of the front foil 60 and rear foil 70 are identified. In particular, FIG. 8 is a graph of front foil angle, rear foil angle and nacelle angle. This graph indicates that the nacelle 50 preferably oscillates between 10° up and 10° down relative to horizontal. The front foil angle corresponds with an angle of attack for the front foil 60. The rear foil angle corresponds with a preferred angle of attack for rear foil 70. Note that in this embodiment the front foil angle and rear foil angle are 180° out of phase. Thus, at any time in the oscillation of the nacelle 50, if the particular orientation of the nacelle 50 is known the desired angle of attack for the front foil 60 and rear foil 70 can be provided by merely reading off of this graph, either by utilizing equations or a database table for looking up appropriate numbers.

With reference to FIG. 9, performance characteristics of this invention are illustrated. In particular, vertical forces for an aft portion of the water craft act up on the mast 26. This net vertical force is after accounting for the weight of the craft 10 and a rider with typical cargo. Not that it is relatively steady and maintains a positive value over time. Net vertical force fore represents lift forces provided by the fore foil 34 on the steering fin 30. This force is typically small and constant due to the generally static nature of the fore foil.

The net horizontal force illustrates how forward forces provided by the flapping foils 60, 70 drive the craft 10 alone. These horizontal forces are usually positive propulsion forces, but do go negative for a portion of the oscillating cycle. Note that by adjusting the angle of attack, volume above the curve when the curve is below a zero force line is less than area under the curve when the curve is above the zero force line. Hence, for a majority of the time positive propulsion forces are provided. When negative propulsion forces are provided for a short period of time, momentum of the craft 10 dampens out these forces so that only minor surging forces are felt by the rider, and not sufficient to be uncomfortable. Net forward propulsion results.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A flapping foil hydrofoil water craft, comprising in combination:

a frame including a mast adapted to extend through a water surface;

an elongate submerged structure pivotably coupled to said mast;

a front foil extending laterally from said submerged structure forward of said mast;

said front foil adapted to pivot relative to said submerged structure to adjust an angle of attack of said front foil;

a rear foil extending laterally from said submerged structure rearward of said mast;

said rear foil adapted to pivot relative to said submerged structure to adjust an angle of attack of said rear foil;

a power plant adapted to pivot said submerged structure relative to said mast;

an angle of attack controller coupled to said forward foil and said rearward foil to adjust the angles of attack of said front foil and said rear foil to provide both positive lift and propulsion to carry and drive the water craft; and wherein said angle of attack control includes a control system with input into the control system correlated with a position of said submerged structure and with front and rear foil angle of attack as outputs, said control including front and rear foil angle of attack adjusters for causing the angle of attack of the front and rear foils to match that specified by the control system.

2. The water craft of claim 1 wherein said power plant includes a push rod coupled to said submerged structure and to a rotating driver, said push rod coupled to said rotating driver at a location on said rotating driver spaced from a pivot of said rotating driver, such that said push rod causes said submerged structure to pivot up and down in an oscillating fashion.

3. The water craft of claim 2 wherein said rotating driver includes a sprocket driven by a chain coupled to a power source.

4. The water craft of claim 3 wherein said power source includes pedals coupled to a crank shaft, with a crank shaft coupled to a drive sprocket that drives said chain, such that the water craft can be powered by a rider.

5. The water craft of claim 2 wherein said power plant includes a motor with a rotating output coupled to said rotating driver.

6. The water craft of claim 1 wherein a steering fin is pivotably coupled to said frame, said steering fin oriented in a substantially vertical plane, said steering fin adapted to rotate about an at least somewhat vertically extending axis.

7. The water craft of claim 6 wherein said steering fin is coupled to handlebars mounted upon said frame, said handlebars adapted to rotate and cause said steering fin to rotate when said handlebars rotate.

8. A flapping foil hydrofoil water craft, comprising in combination:

a frame including a mast adapted to extend through a water surface;

an elongate submerged structure pivotably coupled to said mast;

a front foil extending laterally from said submerged structure forward of said mast;

said front foil adapted to pivot relative to said submerged structure to adjust an angle of attack of said front foil;

a rear foil extending laterally from said submerged structure rearward of said mast;

said rear foil adapted to pivot relative to said submerged structure to adjust an angle of attack of said rear foil;

a power plant adapted to pivot said submerged structure relative to said mast;

an angle of attack controller coupled to said forward foil and said rearward foil to adjust the angles of attack of said front foil and said rear foil to provide both positive lift and propulsion to carry and drive the water craft;

wherein a steering fin is pivotably coupled to said frame, said steering fin oriented in a substantially vertical plane, said steering fin adapted to rotate about an at least somewhat vertically extending axis; and wherein said steering fin includes a fore foil extending laterally from said fin.

9. The water craft of claim 8 wherein said steering fin includes a float extending forward of said steering fin and rigidly coupled to said steering fin, said steering fin pivotably coupled to said frame about a horizontal laterally extending axis.

10. The water craft of claim 1 wherein said angle of attack adjusters are servo motors coupled to said control system, each servo motor including a drive pin coupled to an axle carrying said front fin and said rear fin, such that servo motor rotation can cause said drive pins to move, in turn causing rotation of said front fin and said rear fin to attain desired angles of attack.

11. A flapping foil hydrofoil water craft, comprising in combination:

a frame including a mast adapted to extend through a water surface;

an elongate submerged structure pivotably coupled to said mast;

a front foil extending laterally from said submerged structure forward of said mast;

said front foil adapted to pivot relative to said submerged structure to adjust an angle of attack of said front foil;

a rear foil extending laterally from said submerged structure rearward of said mast;

said rear foil adapted to pivot relative to said submerged structure to adjust an angle of attack of said rear foil;

a power plant adapted to pivot said submerged structure relative to said mast;

an angle of attack controller coupled to said forward foil and said rearward foil to adjust the angles of attack of said front foil and said rear foil to provide both positive lift and propulsion to carry and drive the water craft; and wherein said angle of attack control includes rotating cams abutting portions of said front foil and said rear foil to adjust angle of attack of said front foil and said rear foil, said cams rotating due to force input from pivoting motion of said submerged structure.

12. The water craft of claim 1 wherein the craft includes a hull adapted to float upon a surface of the water, said hull coupled to said frame.

13. The water craft of claim 1 wherein said angle of attack control is adapted to cause an angle of attack of said forward foil and said rearward foil to be out of phase 180° from each other as the submerged structure pivotably cycles relative to the frame.

14. The water craft of claim 1 wherein said angle of attack control is adapted to control balance of the water craft by making fine adjustments to the angle of attack of the front foil and the rear foil.

15. A flapping foil hydrofoil water craft, comprising in combination:

a frame including a mast adapted to extend through a water surface;

an elongate submerged structure pivotably coupled to said mast;

a front foil extending laterally from said submerged structure forward of said mast;

said front foil adapted to pivot relative to said submerged structure to adjust an angle of attack of said front foil;

a rear foil extending laterally from said submerged structure rearward of said mast;

said rear foil adapted to pivot relative to said submerged structure to adjust an angle of attack of said rear foil;

a power plant adapted to pivot said submerged structure relative to said mast;

an angle of attack controller coupled to said forward foil and said rearward foil to adjust the angles of attack of said front foil and said rear foil to provide both positive lift and propulsion to carry and drive the water craft;

wherein said angle of attack control is adapted to control balance of the water craft by making fine adjustments to the angle of attack of the front foil and the rear foil; and wherein said angle of attack control includes depth input, speed input and vehicle gross weight to optimize water craft performance.

16. A flapping foil hydrofoil water craft, comprising in combination:

a frame including a mast adapted to extend through a water surface;

an elongate submerged structure pivotably coupled to said mast;

a front foil extending laterally from said submerged structure forward of said mast;

said front foil adapted to pivot relative to said submerged structure to adjust an angle of attack of said front foil;

a rear foil extending laterally from said submerged structure rearward of said mast;

said rear foil adapted to pivot relative to said submerged structure to adjust an angle of attack of said rear foil;

a power plant adapted to pivot said submerged structure relative to said mast;

an angle of attack controller coupled to said forward foil and said rearward foil to adjust the angles of attack of said front foil and said rear foil to provide both positive lift and propulsion to carry and drive the water craft; and wherein said front foil and said rear foil each include leading edges which are swept slightly to the rear as said leading edges extend from a root of each foil to a tip of each foil, such that weeds and other underwater obstructions naturally fall away from the vehicle during forward motion.

17. The water craft of claim 1 wherein said submerged structure is in the form of a nacelle having a streamlined shell.

18. The water craft of claim 1 wherein said submerged structure oscillates between 5° and 15° both up and down relative to horizontal.

19. The water craft of claim 1 wherein said submerged structure oscillates approximately 10° both up and down relative to horizontal.

* * * * *